United States Patent [19]

Sedille

[11] 3,977,196

[45] Aug. 31, 1976

[54] METHOD AND APPARATUS FOR CONDENSING BY AMBIENT AIR FOR A FLUID IN A THERMAL POWER PRODUCTION PLANT

[75] Inventor: Marcel Sédille, Paris, France

[73] Assignee: Societe des Condenseurs Delas, Paris, France

[22] Filed: Aug. 13, 1975

[21] Appl. No.: 604,372

[30] Foreign Application Priority Data

Aug. 26, 1974 France ..... 74.29100

[52] U.S. Cl. ..... 60/655; 60/693; 165/110

[51] Int. Cl.[2] ..... F01K 23/02

[58] Field of Search ..... 60/655, 693, 690, 691, 60/692; 165/110

[56] References Cited

UNITED STATES PATENTS

| | | | |
|---|---|---|---|
| 2,303,146 | 11/1942 | Thompson | 60/693 X |
| 3,266,246 | 8/1966 | Heller et al. | 60/655 |
| 3,303,646 | 2/1967 | Southam | 60/655 |
| 3,726,085 | 4/1973 | Arenson | 60/655 X |

*Primary Examiner*—Allen M. Ostrager
*Attorney, Agent, or Firm*—Sughrue, Rothwell, Mion, Zinn and Macpeak

[57] ABSTRACT

The invention concerns an aerocondenser for a thermal power station, comprising, more particularly, a first heat exchanger for reheating the air by exchange of heat with a fluid having a freezing point lower than 0° C, for example, a Freon substance, the respective rates and surfaces of exchange between the fluid having a low freezing point and the water vapor being such that the air is heated to a temperature appreciably above 0° C, before beginning to effect a heat exchange with the water vapor to be condensed.

7 Claims, 1 Drawing Figure

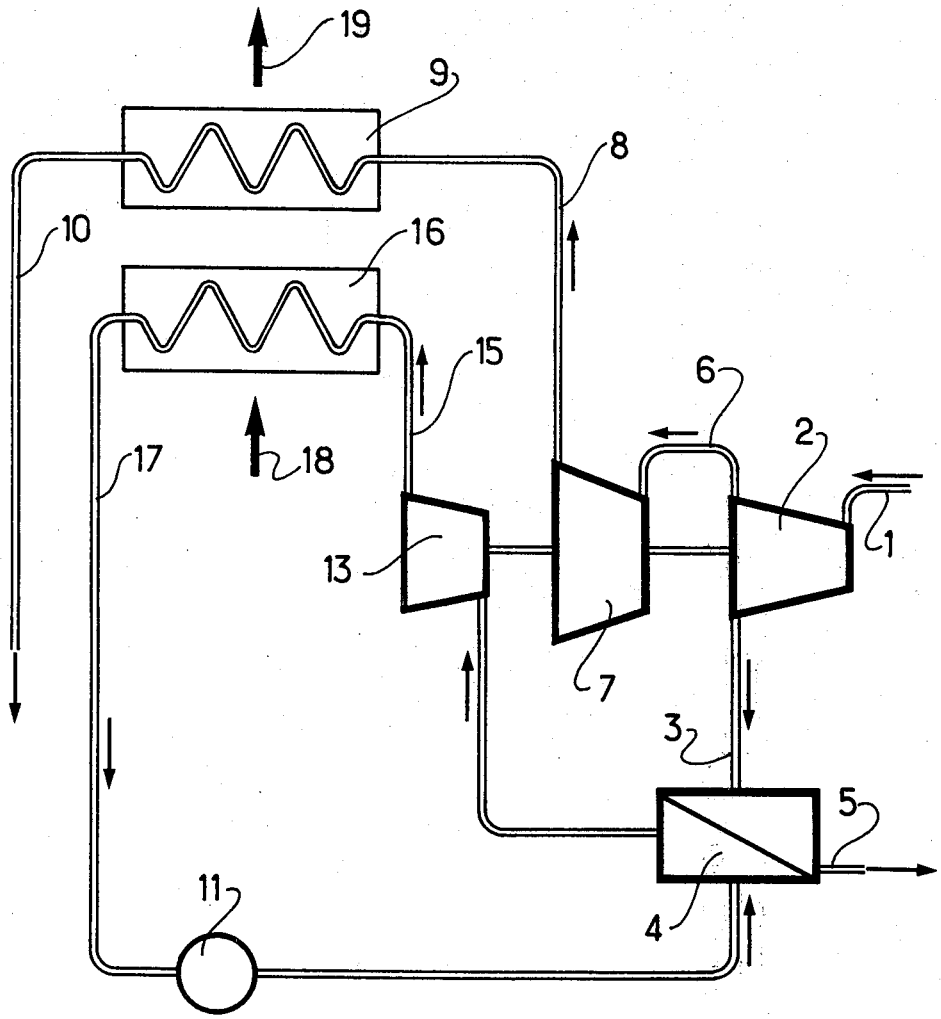
19
9
8
10
16
15
6
2
17
18
1
13
7
3
5
11
4

METHOD AND APPARATUS FOR CONDENSING BY AMBIENT AIR FOR A FLUID IN A THERMAL POWER PRODUCTION PLANT

BACKGROUND OF THE INVENTION

FIELD OF THE INVENTION

The present invention concerns a device for condensing by ambient air of a fluid in a thermal power production plant.

DESCRIPTION OF THE PRIOR ART

It is known that more and more frequently, thermal power production plants and, more particularly, electric power stations, due to their increasing unitary power productions, come up against the lack of water for dissipating the heat given off at the cold source by the cycle fluid, which is, in general, water vapor, because of the insufficient flow of rivers during low water periods and of the restrictions imposed inasmuch as concerns the maximum temperature of the waste water used as a cold source returned into the river. Circumstances lead more and more to the use of ambient air as a cold source, in indirect heat exchangers called "aerocondensers".

For high-power installations, the use of ambient air as a cold source involves several difficulties. In the first instance, in order not to attain dimensions which are too great and hence a price which is too high, circumstances lead to the accepting of a relatively high heating temperature of the ambient air. Due to this, the condensation temperature of the cycle fluid is also high and a great amount of power is lost. Moreover, there is a danger, in winter, of the freezing of the condensed cycle fluid, more particularly in the case of water, when the temperature of the ambient air falls appreciably below 0° C, this requiring, in order to avoid freezing, complicated and expensive arrangements and benefit is not derived from all the possible lowering of the condensation pressure at the cold source, this reducing the gain in power of the power production plant.

The aim of the present invention is to overcome the above disadvantages and to produce a device for condensation by ambient air of the fluid of a thermal power production plant which does not cause the heating of ambient air up to a relatively high temperature, which avoids, in winter, all danger of freezing of the condensed cycle fluid, such as water and thus makes it possible to derive full benefit from the lowering of the temperature of the cold source constituted by the ambient air.

SUMMARY OF THE INVENTION

The device according to the invention is characterized in that it comprises a first zone of indirect exchange of heat between the air and a fluid having a freezing point lower than the minimum temperature which can be reached by ambient air and a second zone of indirect exchange of heat between the air heated at the contact between the first zone of exchange of heat and the fluid of the thermal power production plant, the surface of the first zone of indirect exchange of heat and the flow of the fluid having a low freezing point in the latter being such that the ambient air leaves the said first zone of indirect exchange of heat at a temperature higher than the freezing point of the fluid in the thermal power production plant.

Preferably, the fluid having a low freezing point is vaporized at least partly by heat exchange with a part of the fluid of the thermal power production plant in the gaseous state, drawn off before its insertion in the second heat exchange zone. The fluid of the thermal installation is then preferably subjected to a first expansion producing an external work, then a part of the expanded fluid is sent to effect a heat exchange with the fluid having a low freezing point which is to be vaporized, whereas the other part of the expanded fluid is subjected to at least one further expansion producing an external work and sent to effect a heat exchange with the ambient air in the second heat exchange zone.

The fluid having a low freezing point is, for example, a chlorofluorinated hydrocarbon such as monofluorotrichloromethane.

DESCRIPTION OF THE PREFERRED EMBODIMENT

By way of an example and with reference to the single diagrammatic FIGURE of the accompanying drawing, an installation for condensing by ambient air the vapor of a thermal power production station is described hereinbelow. The vapor under high pressure coming through the tube 1 undergoes a first expansion at an intermediate pressure level in the turbine 2. A part of the exhaust vapor of the turbine 2 is sent through the tube 3 to the indirect heat exchanger 4, which can be called the "steam transformer" and ensures therein the vaporization of the fluid having a low freezing point of the cycle which will be described herebelow. The condensed water in the exchanger 4 is recycled in the usual way through the tube 5.

Furthermore, the remainder of the exhaust vapor from the turbine 2 passes through the tube 6 into a second turbine 7, where it is expanded at low pressure. The exhaust vapor at low pressure, for example 0.2 bar absolute, then goes through the tube 8 to the indirect air-to-water vapor heat exchanger, or aerocondenser 9, where it is condensed at 60° C effecting a heat exchange with the air which has previously effected a heat exchange with the fluid having a low freezing point. The condensed water is then recycled through the tube 10.

The fluid in the liquid state having a low freezing point is then driven back by the pump 11 into the exchanger 4, where it is vaporized by indirect heat exchange with the part of the vapor under medium pressure already mentioned. It is then sent to the expansion turbine 13, coupled on the same shaft as the turbines 2 and 7, where it is expanded at low pressure, for example 2 bars absolute. It then goes through the tube 15 to the indirect heat exchanger for heat exchange with the ambient air, or aerocondenser 16, where it is condensed at about 45° C, then returns to the liquid state through the tube 17 to the pump 11.

The ambient air follows the path shown by the arrows 18 and 19. It undergoes a first heating in the exchanger 16, effecting an indirect heat exchange with the fluid having a low freezing point which is vaporized and expanded. Then it passes into the exchanger 9, where it is again heated, condensing the water vapor of the thermal power production plant.

The heat exchange surfaces and flow rates of the fluids are chosen so that the temperature of the air between the first and the second heat exchange zone be substantially higher than the freezing point of water.

Although the condensation device which has just been described may appear to be the preferable form of embodiment, it will be understood that various modifications can be made thereto without going beyond the scope of the invention, it being possible to replace certain of its elements by others which would fulfill the same technical function therein. More particularly, the choice of the level of the cut-out pressure between the turbines 2 and 7 is a question of technical convenience, to be solved according to the usual rules of calculation for such installations. The turbine 13 can be coupled to the same shaft as the turbines 2 and 7, as shown, or be completely independent therefrom. The condensation zones 16 and 9 can be in several parts, fed by fluids at different pressure levels, a part of a fluid being drawn off between expansion stages of the corresponding turbine to be condensed at a higher temperature level than the remainder of the fluid.

What we claim is:

1. In a method of condensation of the working fluid of a thermal power production plant by ambient air, the improvement comprising the steps of indirectly exchanging heat between the ambient air in a first zone and a fluid having a freezing point lower than the minimum temperature which can be reached by the ambient air, and a second step of indirectly exchanging of heat between the ambient air and a second zone downstream of the first zone of heat exchange with said ambient air with the indirect exchange of heat and the flow of the fluid having a low freezing point in said first zone being such that the ambient air leaves the first zone of indirect heat exchange at a temperature higher than the freezing point of the working fluid in the thermal power production plant.

2. The method of condensation of the working fluid of a thermal power production plant as claimed in claim 1, further comprising the step of vaporizing the low freezing point fluid at least partly by heat exchange with a portion of the working fluid of the thermal power production plant in the gaseous state, prior to said working fluid reaching said second heat exchange zone.

3. The method of condensation of the working fluid of a thermal power production plant as claimed in claim 2, further comprising the step of subjecting the working fluid of the thermal power production plant in the gaseous state to a first expansion and effecting a heat exchange of a portion of the expanded fluid with the low freezing point fluid for vaporization of the same and subjecting another portion of the expanded fluid to further expansion prior to effecting heat exchange of the further expanded working fluid with the ambient air in the second heat exchange zone.

4. In a thermal power production plant including a high pressure working fluid in vapor form, a first turbine receiving said working fluid for obtaining useful work, and a first heat exchanger downstream of said turbine and receiving turbine discharge for condensing said vaporized working fluid by heat exchange with ambient air, the improvement comprising:

a second heat exchanger mounted in the path of said ambient air upstream of said heat exchanger and exchanging heat between the air and a fluid having a freezing point lower than the minimum temperature which can be reached by the ambient air such that the ambient air leaves the second heat exchanger at a temperature higher than the freezing point of the working fluid in the thermal power production plant.

5. The thermal power production plant as claimed in claim 4, further comprising a third heat exchanger for exchanging thermal energy between said working fluid downstream of said first turbine and upstream of said first heat exchanger to said low freezing point fluid and upstream of said second heat exchanger, whereby the low freezing point fluid is at least partially vaporized by a portion of the working fluid in the gaseous state before condensation within said first heat exchanger.

6. The thermal power production plant as claimed in claim 5, further comprising a second turbine receiving working fluid from said first turbine and positioned between said first turbine and said first heat exchanger, and wherein said working fluid after initial expansion within said first turbine is separated into a first portion which is directed to said third heat exchanger and a second portion which is directed to said second turbine such that said second portion of said expanded working fluid is subjected to at least one further expansion performing useful work prior to being sent to said first heat exchanger.

7. The thermal power production plant as claimed in claim 6, wherein said third heat exchanger and said second heat exchanger are connected in a closed loop containing said low freezing point fluid and said closed loop further includes a third turbine intermediate of said third heat exchanger and said second heat exchanger for expansion of said low freezing point fluid subsequent to its being heated within said third heat exchanger and a compressor intermediate of said second heat exchanger and said third heat exchanger for pumping condensed low freezing point fluid from said second heat exchanger to said third heat exchanger.

* * * * *